United States Patent [19]

Chase

[11] 4,195,555

[45] Apr. 1, 1980

[54] METHOD FOR FOLDING A POLYGONAL CONTAINER

[75] Inventor: William L. Chase, Des Moines, Iowa

[73] Assignee: International Drum Corporation, Des Moines, Iowa

[21] Appl. No.: 915,014

[22] Filed: Jun. 13, 1978

[51] Int. Cl.[2] ..... B31B 3/74; B31B 1/90

[52] U.S. Cl. ..... 93/36.8; 93/55.1 M; 93/39.1 P

[58] Field of Search ..... 93/36.8, 39.1 P, 39.1 R, 93/55.1 P, 55.1 M; 229/8, 39 R, 41 C, 47

[56] References Cited

U.S. PATENT DOCUMENTS

| | | | |
|---|---|---|---|
| 3,382,773 | 5/1968 | Pellaton | 93/36.8 |
| 3,977,594 | 8/1976 | Swan | 229/39 R |
| 4,065,047 | 12/1977 | Swan | 229/41 C |
| 4,099,664 | 7/1978 | Swan | 229/39 R |

*Primary Examiner*—Robert L. Spruill
*Assistant Examiner*—K. Y. Lin
*Attorney, Agent, or Firm*—Zarley, McKee, Thomte, Voorhees & Sease

[57] ABSTRACT

The method for forming a polygonal container from a blank comprises placing the blank over a polygonal cone having the same number of sides as the side walls of the polygon to be formed. The blank is inverted during placement over the cone so that the upper edges of the container side walls engage the sides of the cone and so that the bottom closure portion of the container is presented upwardly. The bottom closure is folded inwardly along preformed folding lines into a configuration comprising a plurality of triangular bottom panels equal in number to the side panels and a plurality of interconnecting webs each extending between a pair of adjacent bottom panels. Each bottom panel is hingedly connected to one of the side panels and is inclined upwardly from the lower edge of the side panel to which it is connected to form an acute angle therewith. Each bottom panel has two side edges which abut adjacent side edges of adjacent bottom panels, and having side webs on either side thereof hingedly connecting the bottom panel to an adjacent bottom panel. When the container is folded, the webs form a plurality of vertically disposed ribs which protrude downwardly from the bottom closure and which are arranged in a spoke like configuration. These ribs are fastened together at the center of the spoke like configuration with a clip which retentively engages the ribs.

1 Claim, 13 Drawing Figures

METHOD FOR FOLDING A POLYGONAL CONTAINER

BACKGROUND OF THE INVENTION

1. Field of the Invention

This invention relates to an improvement in a method for forming a polygonal container such as the polygonal container disclosed in U.S. Pat. No. 3,977,594. Specifically, the present invention relates to the use of a cone fixture having polygonal sides for holding the blank for the container during the folding thereof.

2. Discussion of the Prior Art

Various polygonal cartons or containers have been shown in the following patents:

U.S. Pat. No. 3,977,594, U.S. Pat. No. 4,065,047 However, the folding of the cartons shown in the above patents is a somewhat cumbersome procedure without the aid of appropriate fixtures for holding the container blank during folding.

SUMMARY OF THE INVENTION

The present invention relates to the use of a cone shaped fixture having flat polygonal sides thereon for holding the container blank during the folding operation. The polygonal sides of the cone are of the same number as the polygonal side panels of the container. When the container blank is placed over the top of the cone, the flat polygonal sides of the cone force the container into a predetermined polygonal configuration. The bottom closure of the container can then be folded into place to complete the formation of the container.

Therefore, a primary object of the present invention is the provision of a method for folding a polygonal container whereby the polygonal blank is firmly held in a predetermined configuration during the folding of the bottom closure.

A further object of the present invention is the provision of a method whereby the fixture for holding the blank easily accommodates blanks of various sizes and dimensions.

A further object of the present invention is the provision of a method which frees both hands of the operator for grasping and folding the carton.

A further object of the present invention is the provision of a method for folding the container which is simple in operation, and can be done quickly on an assembly line.

DESCRIPTION OF THE PREFERRED EMBODIMENT

Figure 7:
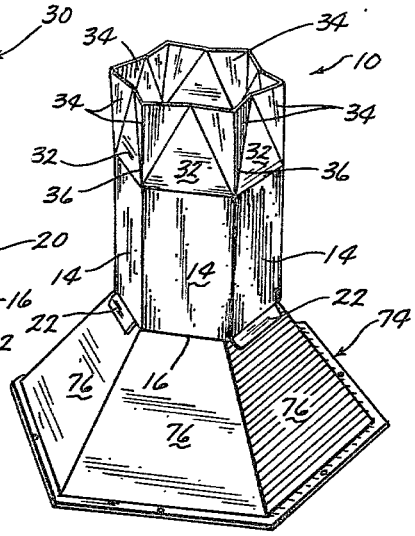
FIGS. 7 and 8 are perspective views showing the sequential positioning of the carton blank on the cone during the folding operation.
Figure 8:
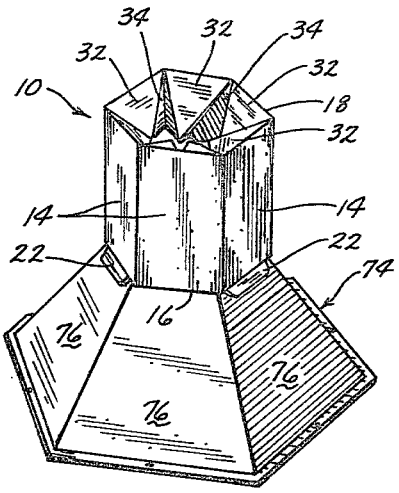

Referring to the drawings, the numeral 10 generally designates a container and the numeral 12 designates a lid for the container. Container 10 is formed from a foldable blank which is shown in FIGS. 6–8 and which may be constructed of corrugated board, paperboard, plastic, or other semi-flexible materials.

Figure 1:
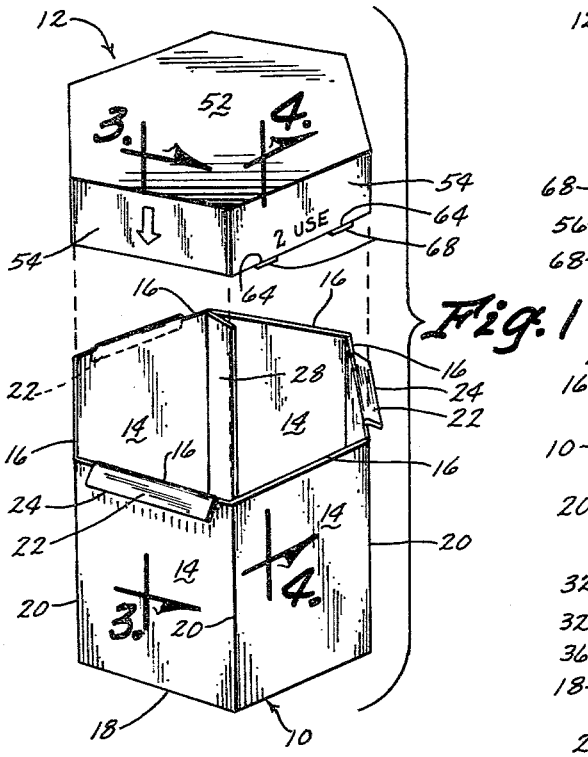
FIG. 1 is a perspective view showing the container and the lid therefor.
Figure 2:
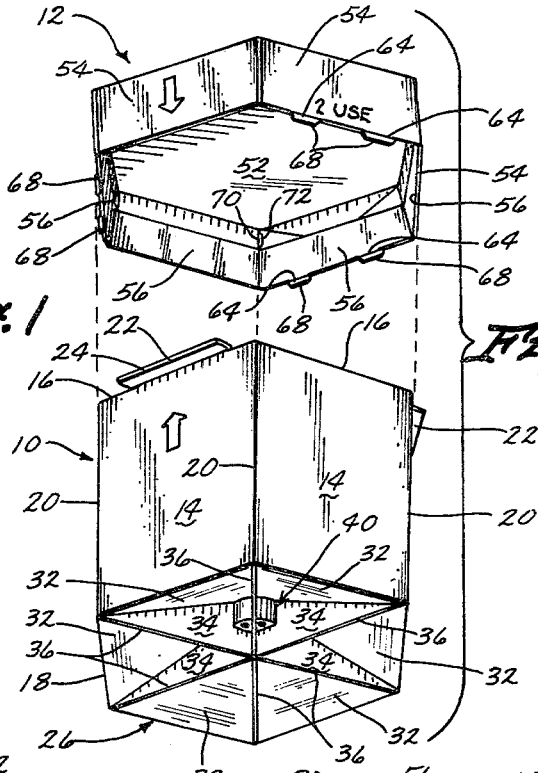
FIG. 2 is a perspective view similar to FIG. 1, but showing the bottom of the container and the under surface of the lid.
Figure 3:
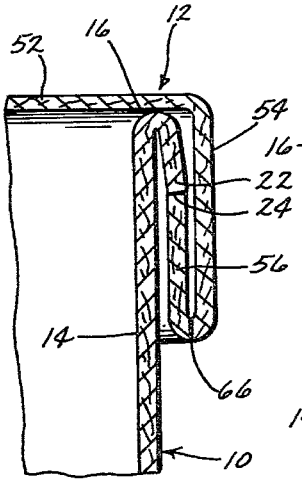
FIGS. 3 and 4 are sectional views taken along lines 3—3 and 4—4 of FIG. 1.

Referring to FIGS. 1–2, the folded and assembled container includes a plurality of rectangular sidewalls 14 each of which includes a top edge 16, a bottom edge 18, and lateral edges 20. Every other top edge 16 is provided with a container locking flap 22 which is foldable outwardly and which includes a downwardly presented flap edge 24 (FIGS. 1–3). Container 10 includes a bottom closure generally designated by the numeral 26. Bottom closure 26 will be described in greater detail hereinafter.

Figure 6:
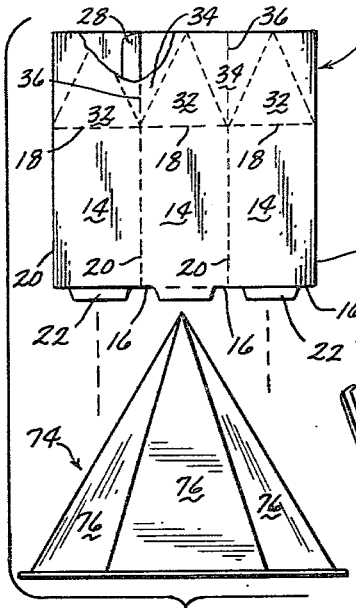
FIG. 6 is a frontal view showing a container blank poised above a cone fixture prior to the folding operation.

A vertical seam 28 joins sidewalls 14 in a tube like configuration, and in FIG. 6 this tube or blank is shown in its original flattened condition. The tube or blank includes pre-scored fold lines which comprise the folds which will be made at edges 16, 18 and 20. Above edges 18 (the blank is shown in an inverted position), is a bottom closure portion generally designated by the numeral 30. Bottom closure portion 30 has a plurality of pre-scored lines which are indicated by the dotted lines thereon. These pre-scored fold lines form a plurality of triangular bottom panels 32, each of which has a triangular base co-existent with bottom edge 18. Between bottom panels 32 are a plurality of inverted triangular webs 34. Each web 34 includes a vertical fold line bisecting the same and designated by the numeral 36.

Figure 13:
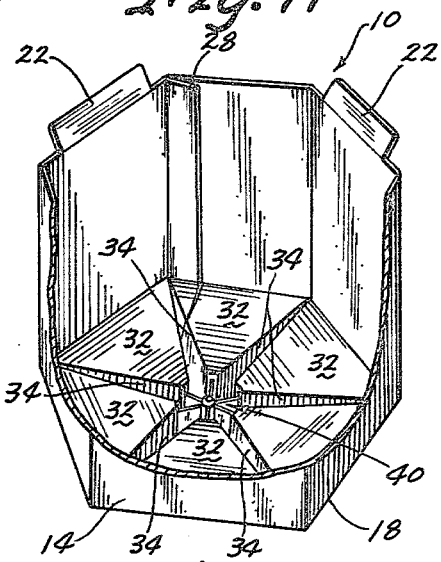
FIG. 13 is a perspective view of the interior surface of the bottom closure having the clip applied thereto.

When completely folded and assembled, container 10 appears as shown in FIGS. 1, 2, 10 and 13. Each web is folded to a double thickness about fold line 36, and extends between a pair of adjacent bottom panels 32. Each bottom panel 32 is hingedly connected to one of the side panels about fold line 18 and is inclined upwardly from the bottom edge 18 of the side panel to which it is connected so as to form an acute angle therewith. Each bottom panel 32 has two side edges which abut adjacent side edges of adjacent bottom panels (FIG. 13). The webs 34 on each side of the bottom panels 32 hingedly connect each bottom panel 32 to an adjacent bottom panel 32, whereby a load which is placed on the bottom interior of container 10 which urges the bottom panels downwardly will be supported by the locking and bearing engagement between the abutting edges of the bottom panels and by the interconnecting webs.

Figure 10:
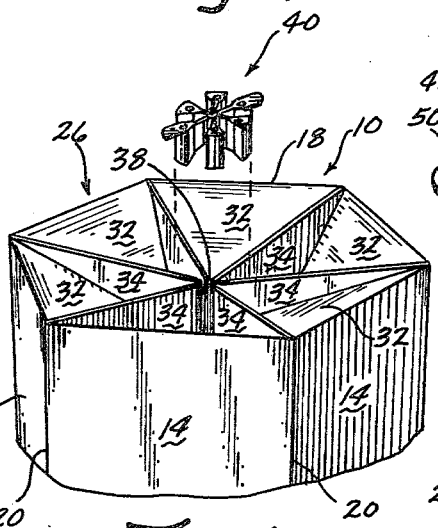
FIG. 10 is a partial perspective view showing the bottom closure of the container and showing the clip poised thereabove for application thereto.

Referring to FIGS. 2 and 10, the undersurface of the bottom closure 26 includes a plurality of ribs which are formed by fold lines 36 of web 34 and which are arranged in a spoke like fashion. These ribs formed by webs 34 and fold lines 36 include inner radial vertical edges 38 (FIG. 10) which are spaced a short distance from one another at the center of the spoke formed by the radiating ribs.

Figure 11:
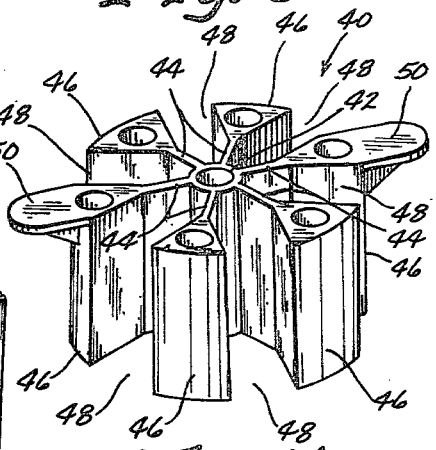
FIG. 11 is a perspective view of the clip used to hold the bottom closure in place.
Figure 12:
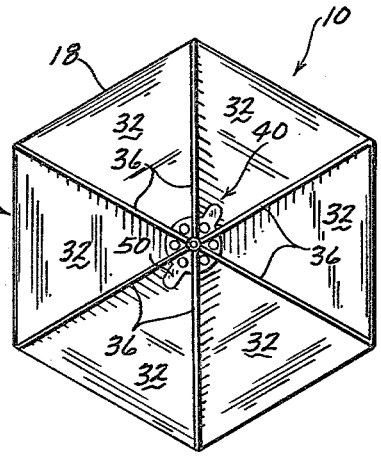
FIG. 12 is a bottom view of the bottom closure having the clip thereon.

A retaining clip 40 retentively engages all of the ribs formed by webs 34 adjacent the inner radial ends 38 thereof. The specific structure of clip 40 is shown in FIG. 11, and includes a hub 42 having a plurality of fingers 44 radiating radially outwardly therefrom. The outer radial end of each finger 44 is provided with an enlarged triangular portion 46 thereon. Fingers 44 and enlarged portions 46 are circumferentially spaced from one another so as to provide a plurality of slots 48 therebetween. Slots 48 extend axially completely through clip 40. A pair of finger tabs 50 extend outwardly from the outer radial edges of clip 40.

Clip 40 is mounted at the inner radial centers of the ribs formed by webs 34 and fold lines 36. The hub 42 of clip 40 is located at the center of the spoke formed by the radiating ribs, and the inner radial ends of each rib are slidably fitted within one of slots 48 within clip 40. Clip 40 is slidably moved upwardly to the extreme upper end of the vertical edges 38 as shown in FIG. 2, so that the bottommost edge of clip 40 is spaced upwardly from bottom edges 18. Edges 38 pass completely through the axial length of slots 48 so that clip 40 can slide freely axially with respect to the axial center of the spoke like array of ribs.

Figure 4:
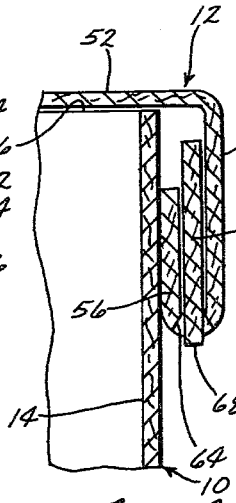

Lid 12 includes a polygonal shaped top wall 52 having a plurality of rectangular side walls 54 which extend downwardly from the lateral edges thereof. Each side wall includes a lid locking flap 56 extending form and folded along the lower edge of each side wall 54. Locking flaps 56 are folded inwardly and into facing engagement with the interior surfaces of sidewalls 54 as is shown in FIGS. 2–4.

Figure 5:
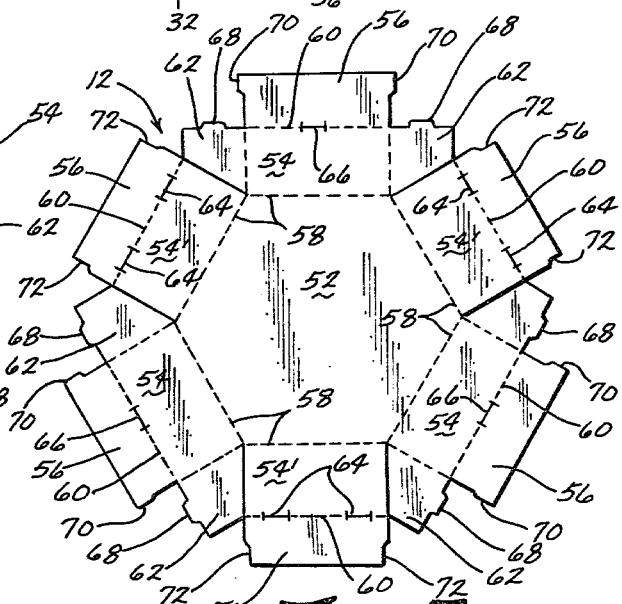
FIG. 5 is a plan view of the container lid in an unfolded configuration.

Referring to FIG. 5, lid 12 is shown in its unfolded blank form. The outer peripheral edges of top wall 52 are shown by fold lines 58. The fold lines between locking flaps 56 and side walls 54 are designated by the numeral 60. Every other side wall 54 is provided with two laterally extending side flaps 62, and the remaining side walls 54 are free from any such side flaps. The side walls without side flaps are designated by the numeral 54'. Fold lines 60 of side flaps 54' are each provided with a pair of H-shaped slits 64 and each side wall 54 is provided with a centrally located slit 66. H-shaped slits 64 are each adapted to receive an upwardly projecting tab 68 on one of side flaps 62 as demonstrated in FIGS. 1–4. The projection of tabs 68 through H-shaped slits 64 forms a lock which retains the lid in its folded configuration. Similarly pairs of lateral tabs 70 on every other locking flap 56 interlock with corresponding notches 72 in the lateral edges of the remaining lock flaps 56, as shown in FIG. 2.

Lid 12 and container 10 are used in the following manner. Prior to shipment the container 10 is filled, and lid 12 is slidably fitted over the upper end of container 10. Depression of lid 12 over the top of container 10 causes the downwardly presented edges of locking flaps 22 to slip by and retentively engage the upwardly presented edges of locking flaps 56, thereby retentively holding lid 12 in position on the top of container 10. (See FIG. 3) The uppermost edge of locking flap 56 is spaced downwardly from top wall 52 of lid 12 a sufficient distance to accommodate container locking flap 22 as shown in FIG. 3.

The number of container locking flaps 22 is less than the number of lid locking flaps 56. The drawings show a relationship whereby there are three locking flaps 22 and six locking flaps 56. However, the ratio may be changed without affecting the invention. For example, there could be two locking flaps 22 and six locking flaps 56 or there could be one locking flap 22 and six locking flaps 26. Furthermore, the number of polygonal sides may be varied, thereby making various permutations and combinations possible with respect to the ratios between flaps 22 and 56. However, in order to provide a reusable lid, it is necessary that there be more locking flaps on the lid 12 than there be on the container top.

After the lid is latched to the top of the container, the container is shipped to its destination. At its destination the container is opened by inserting a knife or other cutting instrument into slot 66 (FIG. 3) and by severing locking flap 56 from lid 12. The only flaps which are severed are those which retentively engage locking flaps 22. For example, in the drawings, there are three locking flaps 22 and six locking flaps 56. With this configuration, only three of the locking flaps 56 are severed, thereby leaving three additional locking flaps 56 for later use.

After severing the locking flaps, the operator can lift the lid 12 from the top of the container, remove the contents, and store the container for later use.

The container can then be used a second time by placing the lid over the container, but in a position which is rotated 30° from the position originally used. This will register the unsevered lock flaps 56 with lock flaps 22. The lid may then be depressed over the top of the container, and the lock flaps 56 will again retentively engage lock flaps 22 as shown in FIG. 3.

By changing the ratio of lock flaps 22 to lock flaps 56, it is possible to increase the number of usages which may be made of lid 12. For example, by placing two lock flaps 22 on the container and six lock flaps 56 on the lid, it would be possible to lock the lid for shipment three separate times.

Referring to FIGS. 6–8, an improved method for folding and forming the container 10 is shown. The container blank shown in FIG. 6 is placed over a polygonal cone 74 which includes a plurality of flat polygonal surfaces 76. Prior to being placed over the cone 74, the blank is inverted so that the top edges 16 engage the surfaces 76 of cone 74 as shown in FIGS. 7 and 8. Once the blank is pressed firmly down over cone 74, it is held in a predetermined polygonal configuration by virtue of the engagement of edges 16 with surfaces 76. Tolerances or variances in the dimensions of the blank are easily accounted for by virtue of the cone shaped configuration of cone 74. Thus, the cone 74 may be used for containers of varying dimensions.

When the polygon is formed into its shape as shown in FIG. 7, the assembler merely folds the bottom closure over into its predetermined position as shown in FIG. 8. The folding of the end closure is facilitated by pre-formed scores or fold lines so that the closure readily assumes the proper position.

Referring to FIGS. 9–13, a method for applying clip 40 to the end closure or the container is as follows: The method comprises the utilization of a fin head fixture 78 having a base pedestal 80 and a vertical support tube 82 which is secured at its lower end to pedestal 80 and which extends upwardly therefrom. Support tube 82 has housed therein a longitudinally slidable plunger 84 which is pivotally secured at its lower end to a foot pedal 86 pivoted about a fulcrum 88. Depression of foot pedal 86 causes upward sliding movement of plunger 84 within tube 82. Plumger 84 is shown in its lowermost position in FIG. 9, and sliding movement of plunger 84 to its uppermost position (not shown) causes the upper end of the plunger to protrude outwardly a predetermined distance from the upper end of tube 82.

Fixed to the upper end of tube 82 are a plurality of fin plates 90, the number of which correspond to the number of ribs formed by webs 34. A centering rim 92 surrounds and is fixed to blades 90. The upper edges of blades 90 protrude a predetermined distance above the uppermost end of tube 82.

Figure 9:
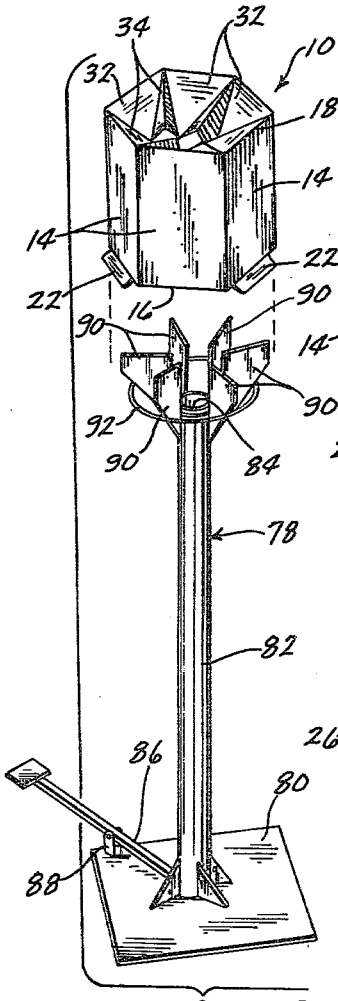
FIG. 9 is a perspective view of the fin head fixture and showing the container poised above the fin head fixture immediately prior to mounting thereon.

In operation, the container blank which has been folded to the position shown in FIG. 8 is removed from cone 74 and is placed above fin head fixture 78 as shown in FIG. 9. Blades 90 are registered below the junctures between the adjacent edges of bottom panels 32. As can be seen in FIG. 13, these junctures form a spoke like configuration which corresponds to the spoke like configuration of plates 90. Container 10 is then lowered over fin plates 90 and fin plates 90 slidably protrude within the junctures between the side edges of bottom panels 32. These junctures are each lined by the two halves of webs 34, and therefore each plate 90 is embraced by the two opposite sides of each web 34. The result of this mating engagement between fin plates 90 and webs 34 is that the ribs formed by webs 34 are prealigned to a proper configuration for receiving clip 40 as shown in FIG. 10. Clip 40 can then be slidably placed over the ribs formed by web 34 so as to lock the ribs together and prevent their movement with respect to one another. The position of clip 40 after it has been inserted is shown best in FIGS. 2 and 13.

From the foregoing description, it will be apparent that container 10 constructed in accordance with the teaching of the present invention, will have a strong weight supporting bottom and can be utilized for numerous shipments. Also, from the foregoing description, it will be apparent that modifications and variations can be made without detracting from the invention, and accordingly the scope of the invention is to be limited as necessitated by the accompanying claims.

What is claimed is:

1. A method for forming a polygonal container from a blank, said blank comprising a plurality of rectangular side panels each being hinged to one another along vertical fold lines between adjacent panels, a bottom closure portion hingedly connected to said rectangular side panels adjacent the lower rectangular edges thereof, said rectangular panels each having upper rectangular edges, said method comprising:

placing said blank over a polygonal cone having the same number of sides as the number of sidewalls in said blank, said blank being inverted during placement over said cone so that said upper edges of said sidewalls engage said sides of said cone and are urged into a predetermined polygonal configuration;

folding said bottom closure portion inwardly about the hinged connection with said lower edges of said rectangular side cartons, simultaneously folding said bottom closure along preformed folding lines into a configuration comprising a plurality of generally triangular bottom panels equal in number to said side panels and a plurality of interconnecting webs, each web extending between a pair of adjacent bottom panels, each said bottom panel being hingedly connected to one of said side panels, being inclined upwardly from said lower edge of said side panel to which it is connected to as to form an acute angle therewith, having two side edges which abut adjacent side edges of adjacent bottom panels, and having side webs on either side thereof hingedly connecting said bottom panel to an adjacent bottom panel, folding each web upon itself in double thickness so that said webs form a plurality of vertically disposed ribs arranged in spoke-like configuration with inner ends located adjacent the center of said spoke-like configuration, fastening said ribs together at the center of said spoke-like configuration with a clip which retentively engages said ribs.

* * * * *